US005132683A

United States Patent [19]

Gould et al.

[11] Patent Number: 5,132,683

[45] Date of Patent: * Jul. 21, 1992

[54] NEON PEDESTRIAN CROSSING SIGNAL

[76] Inventors: Samuel Gould, 2275 - 25th St., San Pedro, Calif. 90372; James S. Gould, 11682 Pine St., Los Alamitos, Calif. 90720

[ * ] Notice: The portion of the term of this patent subsequent to Nov. 21, 2007 has been disclaimed.

[21] Appl. No.: 653,356

[22] Filed: Sep. 24, 1984

[51] Int. Cl.[5] ..... E01F 9/00

[52] U.S. Cl. ..... 340/944; 340/925

[58] Field of Search ..... 340/119, 118, 110, 104, 340/84, 925, 944; 362/812, 228, 229, 231, 234, 263, 92, 219, 225, 217; 40/542, 543, 544, 545; 313/571, 44, 717, 46; 315/50

[56] References Cited

U.S. PATENT DOCUMENTS

| | | | |
|---|---|---|---|
| 2,793,356 | 5/1957 | Hart | 340/944 |
| 3,085,224 | 4/1963 | Becka | 340/944 X |
| 3,101,177 | 8/1963 | Loomis et al. | 40/545 X |
| 3,141,149 | 7/1964 | Lawton | 340/944 |
| 3,564,495 | 2/1971 | Gould et al. | 340/944 |
| 4,435,696 | 3/1984 | Gould et al. | 340/119 |

*Primary Examiner*—Joseph A. Orsino
*Assistant Examiner*—Brent A. Swarthout

[57] ABSTRACT

A pedestrian crossing signal which incorporates a face plate having a "WALK" symbol and a "DONT WALK" symbol. The "WALK" symbol is illuminated by a mercury vapor tubular lamp mounted on the planar rear wall of a housing and which emits white light, and the "DONT WALK" symbol is illuminated by a neon tubular lamp also mounted on the planar rear wall of the housing and which emits red or orange light. At least a portion of the rear wall of the housing on which the tubular lamps are mounted is formed of heat conductive material. This material serves to conduct heat from the neon lamp to the mercury vapor lamp when the former is illuminated to obviate any likelihood of failure of the mercury vapor lamp to become illuminated when it is energized even in cold weather.

3 Claims, 1 Drawing Sheet

NEON PEDESTRIAN CROSSING SIGNAL

BACKGROUND OF THE INVENTION

Federal Standardization Procedures require that the "WALK" symbol be illuminated in lunar white and that the "DONT WALK" symbol be illuminated in Portland orange. This has necessitated the use of mercury vapor tubular lamps to illuminate the "WALK" symbol. However, problems have been encountered because of the tendency of the mercury vapor lamp to fail to be illuminated when energized, especially in cold weather.

The problem is resolved in accordance with the present invention by providing a heat conductive path from the neon lamp in the "DONT WALK" compartment (which normally encounters no start-up problems) to the mercury vapor lamp in the "WALK" compartment. This causes the mercury vapor lamp to be kept in a warm state when it is de-energized, and assures that the mercury vapor lamp will become illuminated the instant it is again energized.

DETAILED DESCRIPTION OF THE ILLUSTRATED EMBODIMENT

Figure 1:
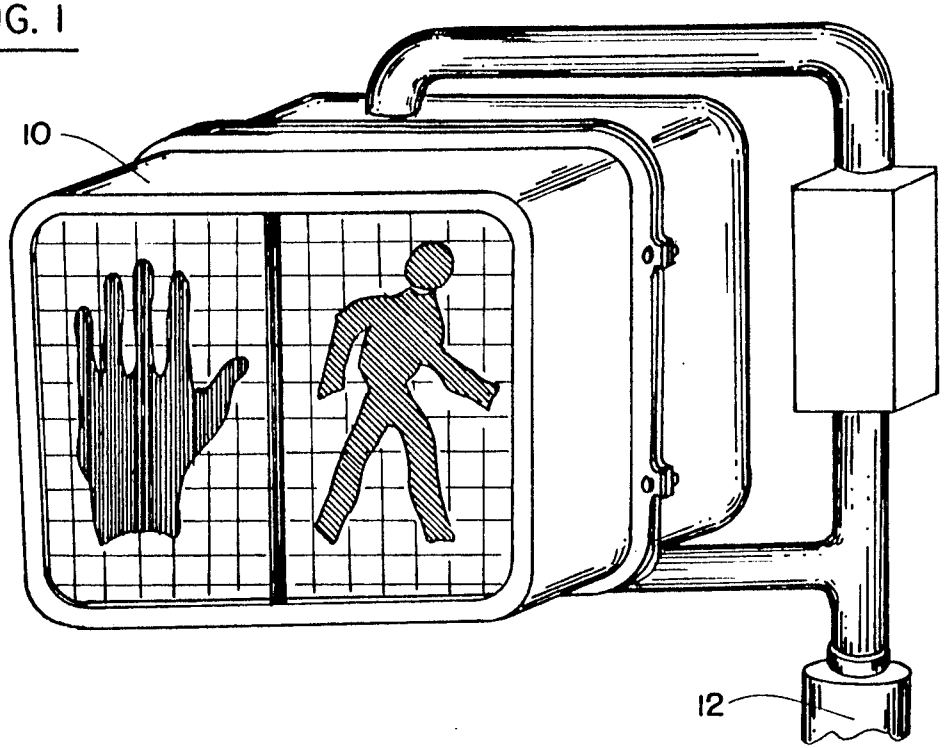
FIG. 1 is a perspective view of a typical signal having symbols for the "DONT WALK" and "WALK" conditions adjacent to one another on the face plate of the lamp.

In FIG. 1 a pedestrian traffic signal 10 is supported in appropriate manner on an upright standard 12. The signal has a face plate, and a "DONT WALK" symbol is formed on one section of the face plate and a "WALK" symbol is formed on the other section of the face plate.

Figure 2:
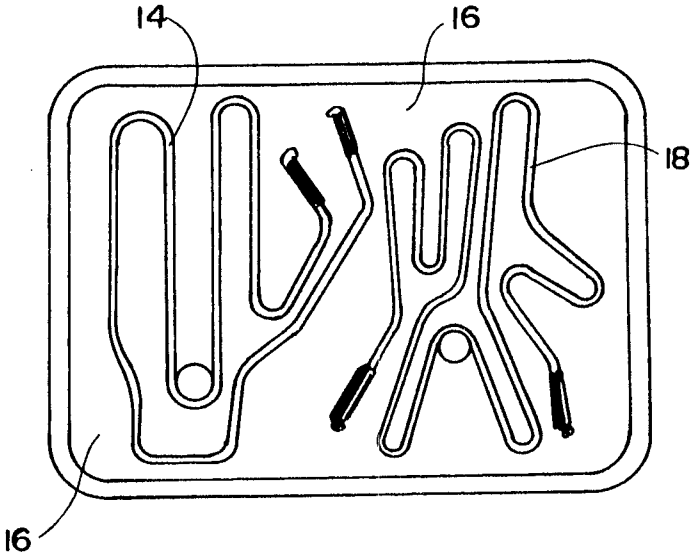
FIG. 2 is a view of the internal housing of the lamp and of the tubular lamps mounted within the housing.

As stated above, the "DONT WALK" symbol may be red or orange, and that symbol is illuminated by a neon tubular lamp 14 (FIG. 2) mounted on the planar rear wall of a housing 16 at one side of the housing. The "WALK" symbol, on the other hand, is illuminated to be white, and that illumination is provided by a mercury vapor tubular lamp 18 also mounted on the rear wall of the housing and located on the other side of the housing 16.

In accordance with the present invention, the rear wall of the housing 16 is formed of any appropriate heat conductive material, such as aluminum. Accordingly, whenever the neon lamp 14 is energized, the heat generated by lamp 14 in the left-hand compartment of the rear wall of the housing is carried by the housing to the lamp 18 in the right-hand compartment so as to maintain the mercury vapor lamp 18 in a warm condition. With such a combination, there is no problem in starting up the mercury vapor lamp and it becomes illuminated the instant it is energized.

If desired, rather than making the entire housing 16 of heat conductive material, a heat conductive strip may be mounted on the housing 16 for carrying the heat from the left-hand compartment to the right-hand compartment.

It will be appreciated, therefore, that although a particular embodiment of the invention has been shown and described, modifications may be made. It is intended in the claims to cover all modifications which come within the true spirit and scope of the invention.

We claim:

1. A pedestrian traffic signal unit including: a housing having a planar rear wall and defining first and second compartments; a face plate mounted on said housing having a "DONT WALK" symbol formed on one section thereof in front of the first compartment and having a "WALK" symbol formed on a second section thereof in front of the second compartment; a first electrically energized tubular lamp mounted on the rear wall of said housing within the first compartment and extending across the surface of the rear wall to illuminate the "DONT WALK" symbol on the face plate; and a second electrically energized tubular lamp mounted on the rear wall of said housing within the second compartment and extending across the surface of said rear wall to illuminate the "WALK" symbol on the face plate, the rear wall of said housing being formed at least in part of heat conductive material to provide a heat-conductive path from the first tubular lamp to the second tubular lamp to cause heat generated by said first tubular lamp to be carried to said second tubular lamp in the second compartment to cause the second tubular lamp to be maintained in a warm state when the first tubular lamp is energized.

2. The combination defined in claim 1, in which the first tubular lamp is a neon type and in which the second tubular lamp is a mercury vapor type.

3. The combination defined in claim 1, in which the entire rear wall of the housing is formed of heat conductive material.

* * * * *